US009663848B2

(12) United States Patent
Rafetzeder

(10) Patent No.: US 9,663,848 B2
(45) Date of Patent: May 30, 2017

(54) HIGH HEAT-RESISTANT ALUMINIUM CASTING ALLOY AND CASTING FOR COMBUSTION ENGINES CAST FROM SUCH AN ALLOY

(71) Applicant: Nemak Linz GmbH, Linz (AT)

(72) Inventor: Michael Rafetzeder, Rohr im Kremstal (AT)

(73) Assignee: Nemak Linz GmbH, Linz (AT)

( * ) Notice: Subject to any disclaimer, the term of this patent is extended or adjusted under 35 U.S.C. 154(b) by 0 days.

(21) Appl. No.: 14/904,834

(22) PCT Filed: Jul. 15, 2014

(86) PCT No.: PCT/EP2014/065130
§ 371 (c)(1),
(2) Date: Jan. 13, 2016

(87) PCT Pub. No.: WO2015/010956
PCT Pub. Date: Jan. 29, 2015

(65) Prior Publication Data

US 2016/0168665 A1 Jun. 16, 2016

(30) Foreign Application Priority Data

Jul. 22, 2013 (DE) ..... 10 2013 107 810

(51) Int. Cl.
*C22C 21/12* (2006.01)
*C22C 21/14* (2006.01)
(Continued)

(52) U.S. Cl.
CPC ..... *C22C 21/18* (2013.01); *B22D 21/007* (2013.01); *B22D 25/02* (2013.01); *C22C 21/14* (2013.01); *C22F 1/057* (2013.01)

(58) Field of Classification Search
CPC ..... C22C 21/12; C22C 21/14; C22C 21/02
See application file for complete search history.

(56) References Cited

U.S. PATENT DOCUMENTS 6,419,769 B1 * 7/2002 Lee ..... C22C 21/04 148/439
2003/0192627 A1 10/2003 Lee et al.
2006/0133949 A1 6/2006 Laslaz

FOREIGN PATENT DOCUMENTS

CN 1643171 A 7/2005
DE 102009012073 A1 9/2010
(Continued)

OTHER PUBLICATIONS

Zak et al., "Heat-Resistant Aluminum Casting Alloys for Cylinder Heads in Direct Competition", Giesserei-Prazis, Jun. 2009, pp. 199-202.

*Primary Examiner* — Roy King
*Assistant Examiner* — Janelle Morillo
(74) *Attorney, Agent, or Firm* — The Webb Law Firm

(57) ABSTRACT

The present invention relates to an aluminium casting alloy having (in % by weight) Cu: 6.0-8.0%, Mn: 0.3-0.055%, Zr: 0.18-0.25%, Si: 3.0-7.0%, Ti: 0.05-0.2%. Sr: up to 0.03%, V: up to 0.04%, Fe: up to 0.25%, remainder aluminium and unavoidable impurities, and a casting for a combustion engine. The aluminium casting alloy according to the invention has high mechanical properties after a longer operating duration at high temperatures and at the same time can be cast without any problems. Furthermore, the casting according to the invention has optimised mechanical properties during operation at high temperatures and at the same time can be produced in an operationally reliable manner in terms of casting technology.

12 Claims, 4 Drawing Sheets

(51) Int. Cl.

| | |
|---|---|
| ***C22C 21/18*** | (2006.01) |
| ***C22F 1/057*** | (2006.01) |
| ***B22D 21/00*** | (2006.01) |
| ***B22D 25/02*** | (2006.01) |

(56) References Cited

FOREIGN PATENT DOCUMENTS

| | | | | |
|---|---|---|---|---|
| DE | 102011083968 | A1 | | 4/2013 |
| JP | 04202737 | A | * | 7/1992 |
| JP | 11199960 | A | * | 7/1999 |

* cited by examiner

HIGH HEAT-RESISTANT ALUMINIUM CASTING ALLOY AND CASTING FOR COMBUSTION ENGINES CAST FROM SUCH AN ALLOY

CROSS-REFERENCE TO RELATED APPLICATIONS

This application is the United States national phase of International Application No. PCT/EP2014/065130 filed Jul. 15, 2014, and claims priority to German Patent Application No. 10 2013 107 810.9 filed Jul. 22, 2013, the disclosures of which are hereby incorporated in their entirety by reference.

BACKGROUND OF THE INVENTION

Field of the Invention

The invention relates to an aluminium casting alloy which can be cast very well and also has a high strength in the hot state after a long operating duration at high operating temperatures.

Likewise, the invention relates to a component for combustion engines which is cast from an aluminium alloy. Such components are, in particular, cylinder heads or engine blocks.

Description of Related Art

Increasing requirements for, on the one hand, the engine power and, on the other hand, the minimisation of fuel consumption and weight, lead to higher and higher requirements for the mechanical and thermal resilience of engine components cast from aluminium alloys. Therefore, aluminium casting alloys which are suitable for the production of such components must have a high yield strength both at room temperature and at operating temperature, a high ultimate strain, a high thermal conductivity, a low thermal expansion, a high creep resistance, as well as favourable processing properties, which include a good fluidity and low hot cracking tendency. At the same time, these alloys should be able to be cast well in order to enable a reliable production of the castings.

A large number of material concepts is known with which these partially opposing requirements for aluminium casting materials of the type discussed here are fulfilled. These material concepts include aluminium casting alloys of the alloy groups Al—Si—Mg and Al—Si—Cu. In the case of these alloys, however, at operating temperatures of over 250° C., the coarsening of the hardening phase can occur as a consequence of diffusion of the elements contributing to the hardening, such as Cu, Mg and Zn, and thus, in conjunction with this, a strong reduction of the mechanical characteristic values occurs. The aim of the development of new alloys for the aluminium casting of components for combustion engines is therefore an optimised high temperature resistance (see article "Warmfeste Aluminiumgusslegierungen für Zylinderkopfe in direktem Wettbewerb" (Heat-resistant aluminium casting alloys for cylinder heads in direct competition), June 2009 GIESSEREIPRAXIS, pages 199-202).

It is known that by addition of a high amounts of Cu, the heat resistance of Al casting alloys can increase. One group of alloys which uses this positive influence of Cu on the heat resistance is known by the name "AlCu7xx". Under this, for example, falls the alloy "AlCu7MnZr" which contains, besides Al and accompanying elements, (in % by weight) 6.72% Cu, 0.22% Zr, 0.11% Ti, 0.5% Mn as well as the traces of Fe, Mg and Zn which are attributable to impurities.

The superior heat resistance of aluminium casting alloys of this type which have a Cu content, however, are faced with an increased hot cracking tendency and a greatly limited castability. Thus the AlCu7MnZr alloy specified above also proves to be practically uncastable.

SUMMARY OF THE INVENTION

With the background of the prior art explained above, the object of the invention was to name an aluminium casting alloy which still has high mechanical properties after a longer operating time at high temperatures and at the same time can be cast well.

Additionally, a casting for a combustion engine should be created which has optimised mechanical properties for operation at high temperatures and at the same time can be produced in an operationally reliable manner in terms of casting technology.

With regard to the aluminium casting alloy, this object has been solved according to the invention.

With regard to the casting, the solution of the object referred to above exists in that such a casting is cast from an aluminium casting alloy according to the invention. Therein, the alloy according to the invention is suitable in particular for the production of cylinder heads with casting technology, which are exposed to extreme thermal and mechanical loads during practical operation.

The aluminium casting alloy according to the invention contains, besides aluminium and unavoidable impurities obtained during production, (in % by weight) 6.0-8.0% Cu, 0.3-0.55% Mn, 0.18-0.25% Zr, 3.0-7.0% Si, 0.05-0.2% Ti, up to 0.03% Sr, up to 0.04% V and up to 0.25% Fe.

Components cast from an aluminium casting alloy composed in the manner according to the invention each regularly achieve, on average, tensile strengths Rm of more than 260 MPa, a Brinell hardness HB of at least 90 HB, a yield strength Rp0,2 of at least 170 MPa and an ultimate strain A of at least 1.65%, at room temperature with a static load, in the T6W state, i.e. solution annealed and artificially aged for 4 hours at 240° C.

After a long-term heat treatment at 300° C. lasting 100 hours and which is equal to a practical operation in a combustion engine over a corresponding duration, components cast from an aluminium casting alloy according to the invention on average each have a tensile strength Rm of at least 190 MPa, a yield strength Rp0,2 of at least 90 MPa, a hardness HB of at least 67 HB and an ultimate strain A of at least 3.5% at room temperature with a static load. These values also remain stable after longer operation at high temperatures. Thus, for example, during an operation at 300° C. lasting over 500 hours, practically no change to the strength and hardness occurs, contrary to which the ultimate strain increases to more than 4.5%.

If the mechanical properties of the components cast from the aluminium casting alloy according to the invention are measured after a heat treatment implemented for 500 hours at 300° C. at the heat treatment temperature of 300° C., then respectively on average, the tensile strength Rm amounts to at least 80 MPa, the yield strength Rp0,2 to at least 60 MPa and the ultimate strain A to at least 24%.

The high temperature resistance of an aluminium casting alloy according to the invention is consequently clearly higher than for conventional aluminium casting alloys used today as standard to cast combustion engine components. At the same time, the mechanical properties of the components cast from an aluminium alloy according to the invention in the T6W delivery state are on the level of the conventional high-strength AlCu7xx alloys. Unlike these alloys, the aluminium casting alloy according to the invention is distinguished, however, by a good castability and an optimum, resistant solidification behaviour. Practical tests have shown that components cast from an aluminium casting alloy according to the invention have no optically noticeable cracks and as far as possible are pore-free. The aluminium casting alloy according to the invention thus allows the production of casting parts in an operationally reliable manner in terms of casting, which have an optimum resilience even at high operating temperatures.

Cu is contained in the alloy according to the invention in amounts of 6.0-8.0% by weight, in order to ensure the required heat resistance. At the same time, Cu contributes to the high temperature strength of the aluminium casting alloy. These positive influences of Cu can be ensured particularly reliably in an aluminium casting alloy according to the invention, if the Cu content amounts to at least 6.5% by weight. At the same time, a negative effect of the presence of Cu on the mechanical properties, such as a reduction of the ultimate strain, can be eliminated particularly reliably in that the Cu content of the aluminium casting alloy according to the invention is limited to, at most, 7.5% by weight.

The Si content of an aluminium casting alloy according to the invention ranges from 3.0-7.0% by weight. Therein, the emphasis of the properties, on the one hand, on the castability and, on the other hand, on the heat resistance, can be set by a corresponding adjustment of the Si content within this content range.

Maximised mechanical properties of the components cast from an aluminium casting alloy according to the invention for sufficient castability can be achieved in that the Si content of the aluminium casting alloy according to the invention amounts to less than 5.0% by weight. The resistance of the aluminium casting alloy according to the invention to fluctuations in the phase formation can therein be increased in that the Si content is increased to at least 3.5% by weight. In the case of such increased Si contents, the aluminium casting alloy according to the invention is proven to be stable with regard to its properties and its behaviour during a heat treatment. At the same time, the range in which the highest strengths are achieved with good operationally reliable castability, in particular during a high temperature operation, can be reached particularly reliably by limiting the Si content to at most 4.5% by weight.

If, on the other hand, for example for the production of a filigree, complexly formed component, particular value is placed on an optimal castability with at the same time superior heat resistance, then the Si content of the aluminium casting alloy according to the invention can be increased to 5.0% by weight, in particular 5.5% by weight. An aluminium casting alloy according to the invention which, on the one hand, is optimised with respect to the castability and, on the other hand, with respect to the heat resistance, therein then results if the Si content is limited to at most 7% by weight, in particular at most 6.5% by weight.

Amounts of Mn content of 0.3-0.55% by weight contribute to the increase of the strength of components cast from an aluminium casting alloy according to the invention. This positive effect in particular then occurs if the Mn content of the aluminium casting alloy according to the invention amounts to 0.4-0.55% by weight.

Zr in amounts of 0.18-0.25% by weight contributes substantially to the fineness of grain of the structure of a casting cast from an aluminium casting alloy according to the invention. Additionally, Zr contributes above all to increased temperature stability and thus strength at temperatures of more than 250° C. This then applies, in particular, if the Zr content of the aluminium casting alloy according to the invention amounts to 0.2-0.25% by weight.

Also the amounts of Ti provided in the aluminium casting alloy according to the invention of 0.05-0.2% by weight support the formation of a fine-grained structure and contribute to the increase of the strength. In order to be able to use this effect particularly reliably, it can be expedient to set the Ti content of an aluminium casting alloy according to the invention to at least 0.08% by weight. An upper limit of the corridor in which an optimised effect of the titanium present in the aluminium casting alloy according to the invention is to be expected amounts to 0.12% by weight.

Sr is optionally added to the aluminium casting alloy according to the invention for refinement. The addition of Sr is therefore useful in particular for aluminium casting alloys according to the invention which have Si contents of at least 5.0% by weight. Herein, it proves to be expedient to provide an Sr content of at least 0.015% by weight. In particular for low Si contents, it is, however, sufficient to add optionally up to 0.025% by weight to the aluminium casting alloy in order to also make use of the refinement effect there.

According to the explanations above, a first variant of the aluminium casting alloy according to the invention, for which the emphasis is set on a sufficient castability with simultaneously maximised mechanical properties, contains (in % by weight) 6.0-8.0% Cu, 0.3-0.55% Mn, 0.18-0.25% Zr, up to 0.25% Fe, 3.0-<5.0 Si, 0.05-0.2% Ti, up to 0.04% V and up to 0.025% Sr. An embodiment of this variant which is further optimised for good castability with regard to maximised mechanical properties, therein consists of aluminium and unavoidable impurities as well as (in % by weight) 6.5-7.5% by weight Cu, 0.4-0.55% by weight Mn, 0.20-0.25% Zr, up to 0.12% Fe, 3.5-4.5% Si, 0.08-0.12% Ti, up to 0.02% V and 0.05-0.02% Sr.

If, however, the aluminium casting alloy according to the invention is varied such that, in its case, the emphasis is set on a further improved castability with simultaneously still very good mechanical properties, an aluminium casting alloy according to the invention contains (in % by weight) 6.0-8.0% Cu, 0.3-0.55% Mn, 0.18-0.25% Zr, up to 0.25% Fe, 5.0-7.0 Si, 0.05-0.02% Ti, up to 0.04% V and 0.01-0.03% Sr. An embodiment of this variant which is optimised with respect to optimum castability with high mechanical properties then consists of aluminium and accompanying elements obtained during production as well as (in % by weight) 6.5-7.5% by weight Cu, 0.4-0.55% by weight Mn, 0.20-0.25% Zr, up to 0.12% Fe, 5.5-6.5% Si, 0.08-0.12% Ti, up to 0.02% V and 0.015-0.03% Sr.

BRIEF DESCRIPTION OF THE DRAWINGS

Below, the invention is explained in more detail by means of exemplary embodiments. Herein are shown.

DESCRIPTION OF THE INVENTION

Three aluminium casting alloys according to the invention E1, E2, E3 were melted, the composition of which is specified in Table 1. For comparison, a comparison alloy V was melted, the composition of which that is likewise listed in Table 1 corresponds to the known aluminium casting alloy "AlCu7MnZr".

Figure 1:
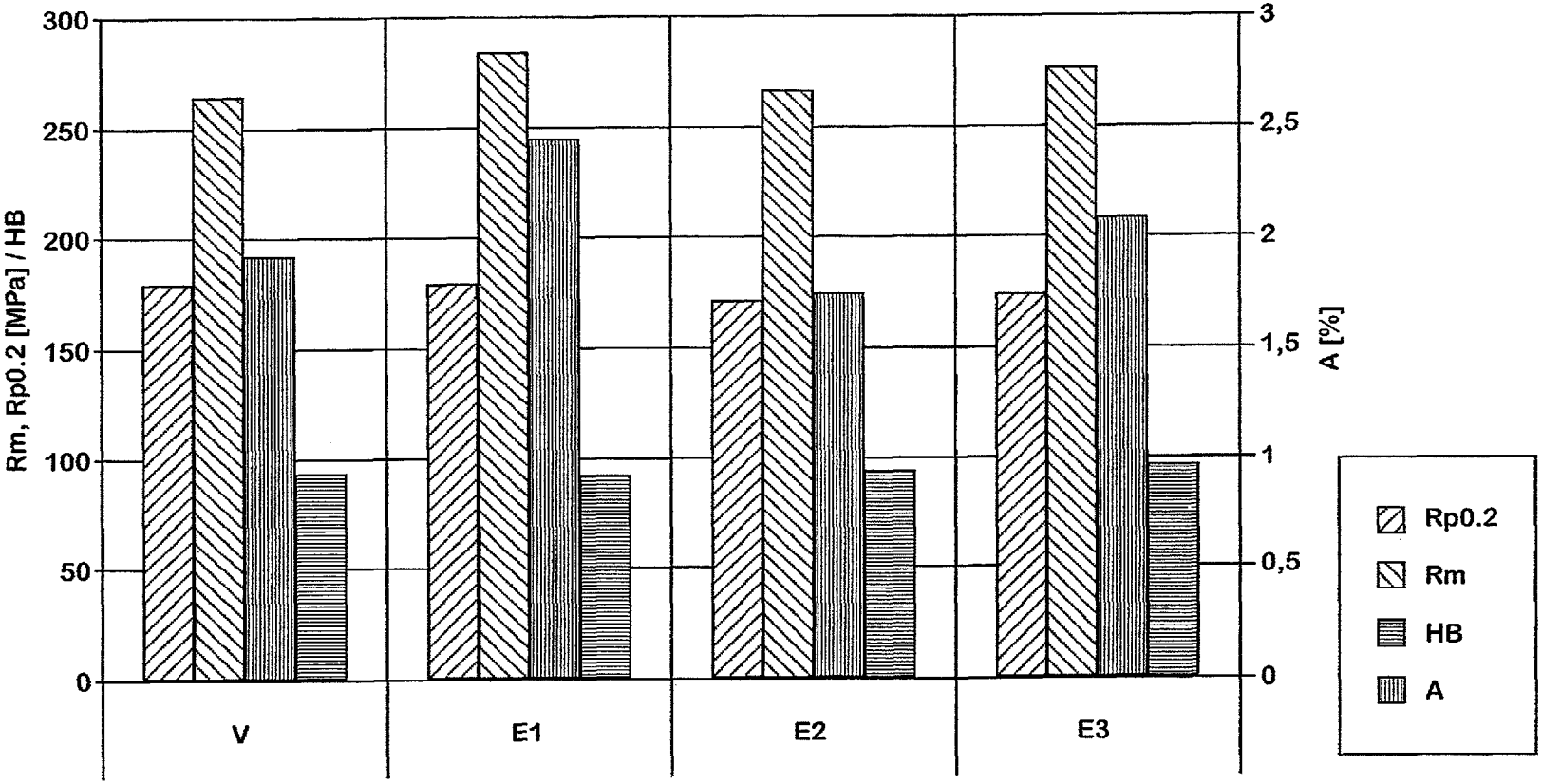
FIG. 1 a diagram in which the respective mechanical properties, determined at room temperature, of casting samples made from three aluminium casting alloys according to the invention E1, E2, E3 are compared to the mechanical properties of a casting sample made from a comparison alloy V, each in the T6W state.

Cylinder heads were cast from the aluminium casting alloys E1, E2, E3, V, which underwent a T6W treatment after solidification. Therein, the cylinder heads are solution annealed at 480-500° C. respectively over seven and a half hours, are subsequently quenched with water and then aged over four hours at 240° C. Subsequently, the mechanical properties, tensile strength Rm, yield strength Rp0,2, Brinell hardness HB and ultimate strain A are determined for the thus treated cylinder heads in the region of the combustion chambers. Therein, respectively forty casting samples consisting of the aluminium casting alloy E1 and E2 and respectively fifteen casting samples consisting of the aluminium casting alloy E3 and the comparison alloy V were tested. The arithmetic average of the mechanical properties determined for each of the casting samples are specified in Table 2 in detail and are summarised in FIG. 1 graphically.

In order to test the temperature influence on the long-term development of the mechanical characteristic values, cylinder heads cast from the aluminium casting alloys E1, E2 and V underwent a long-term heat treatment in which they were kept at a temperature of 300° C. firstly over a duration of eight hours, then over a duration of 100 hours and finally over a duration of 300 hours. A sample was taken from the combustion chamber for each of the thus heat-treated cylinder heads after completion of each heat treatment duration and the yield strength Rp0,2, the tensile strength Rm and the ultimate strain A were determined at room temperature for these casting samples. The arithmetical average of the mechanical properties determined for the thus treated casting samples are specified in Table 3. The test results show that after 100 hours, the tensile strength Rm and the yield strength Rp0,2 are substantially stable in the case of the cylinder heads cast from the aluminium casting alloys according to the invention E1, E2, whilst the ultimate strain A increases. The cylinder heads produced from the comparison alloy each have, on the other hand higher strengths, however their ultimate strain A lies clearly below the ultimate strain A determined for the samples according to the invention respectively.

Figure 2:
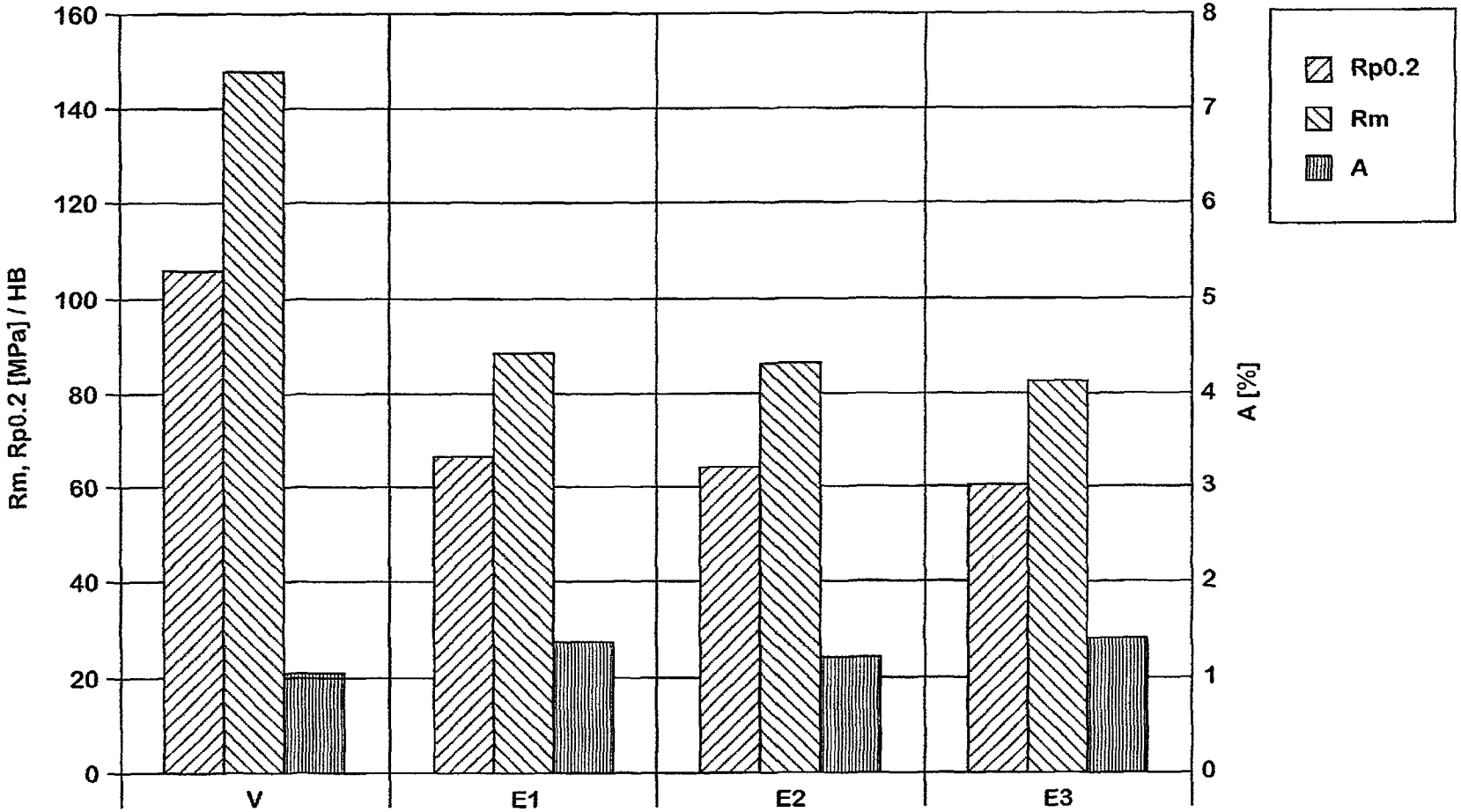
FIG. 2 a diagram in which the respective tensile strength Rm, yield strength Rp0,2 and ultimate strain A, determined at 300° C., of casting samples of the three aluminium casting alloys according to the invention E1, E2, E3 and the comparison sample V are compared after a respective heat treatment implemented at 300° C. over 500 hours.

Finally, further cylinder heads produced from alloys according to the invention E1, E2, E3 and V underwent a long-term heat treatment which was likewise carried out at 300° C. and which extended over 500 hours. Then also here the yield strength Rp0,2, the tensile strength Rm and the ultimate strain A were determined for 300° C. samples which were in turn taken from the region of the combustion chamber. The arithmetical average values formed therein from the obtained values are listed in Table 4 and summarised in FIG. 2.

Additionally to the tests on the samples produced from the alloys according to the invention E1, E2, E3 and from the high heat-resistant alloy V, comparisons were also made to conventional standard casting alloys, the castability of which—in contrast to the comparison alloy V which has a clearly poorer castability—is comparable to the castability of the alloys according to the invention. For this purpose, the same cylinder heads as for the samples of E1, E2, E3 and V were produced from the standard casting alloys S1 and S2, the compositions of which that are listed in Table 5 correspond to the known aluminium casting alloys "AlSi7Cu0.5Mg" and "AlSi6Cu4". The cylinder heads cast from the standard alloys S1 and S2 each underwent the heat treatments which are typical for them. Thus the cylinder heads cast from the alloy S1 underwent a T6 air heat treatment and the cylinder heads cast from the alloy S2 underwent a T6W heat treatment.

Figure 3:
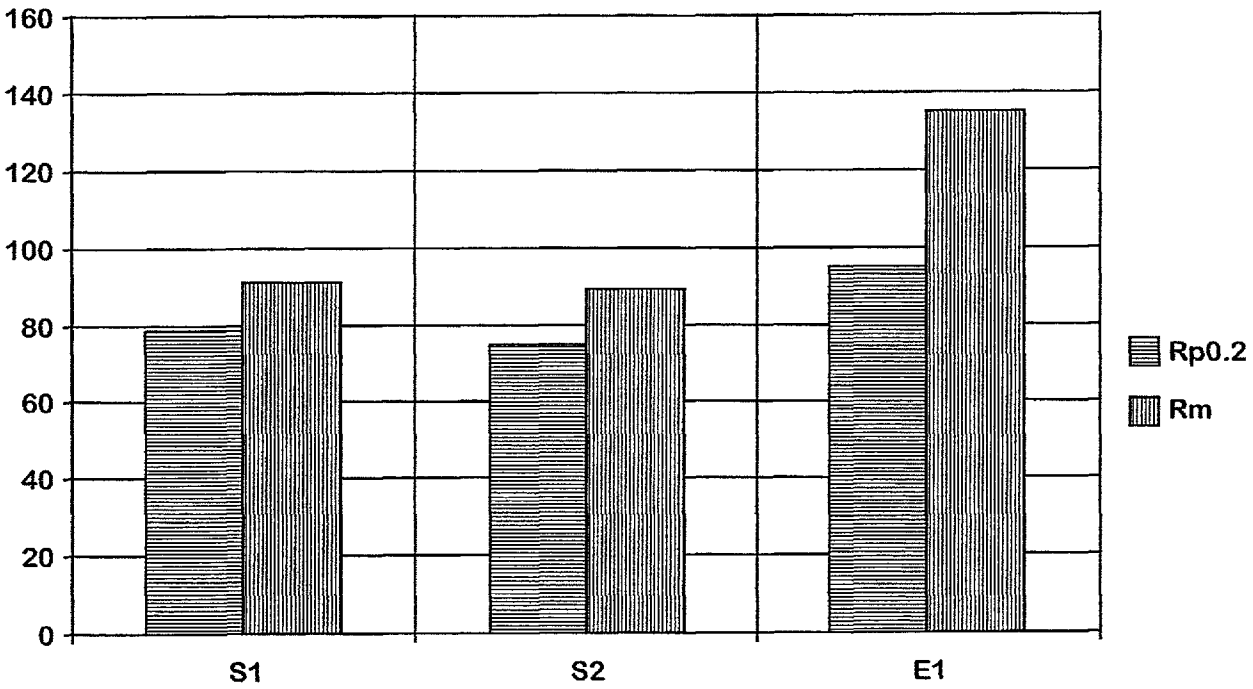
FIG. 3 a diagram in which the respective tensile strength Rm and yield strength Rp0,2, determined at 250° C., of casting samples of the aluminium casting alloy according to the invention E1 and the standard casting alloys AlSi6Cu4 and AlSi7Cu0.5Mg are compared after a respective heat treatment implemented at 250° C. over 500 hours.

In order to compare the heat resistance of the alloys according to the invention to the standard alloys used today, samples produced from the alloys S1, S2 and the alloy according to the invention E1 underwent a long-term heat treatment implemented at 250° C. and extending over 500 hours. Then also here the yield strength Rp0,2 and the tensile strength Rm were determined for 250° C. hot samples which were taken from the region of the combustion chamber. The arithmetical average values formed therein from the obtained values are listed in Table 6 and summarised in FIG. 3.

Figure 4:
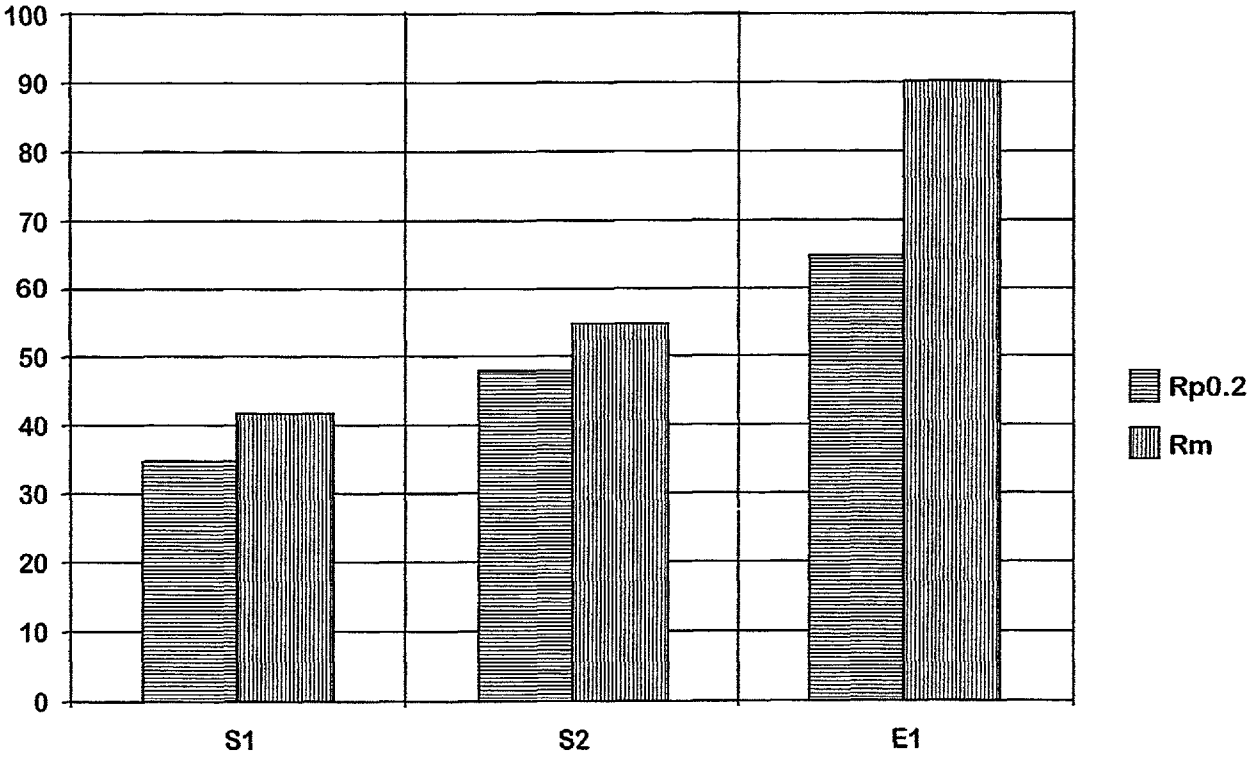
FIG. 4 a diagram in which the respective tensile strength Rm and yield strength Rp0,2, determined at 300° C., of casting samples of the aluminium casting alloy according to the invention E1 and the standard casting alloys AlSi6Cu4 and AlSi7Cu0.5Mg are compared after a respective heat treatment implemented at 300° C. over 500 hours.

Finally, further cylinder heads generated from the alloy according to the invention E1 and the standard alloys S1 and S2 underwent a long-term heat treatment which was implemented at 300° C. and which extended over 500 hours. Then in turn, the yield strength Rp0,2 and the tensile strength Rm were determined for 300° C. hot samples which were in turn taken from the region of the combustion chamber. The arithmetical average values formed from the thus obtained values are listed in Table 7 and summarised in FIG. 4.

The tests prove that for the cylinder heads cast from the alloys according to the invention E1, E2, E3, no cracks were able to be detected and the structure of the castings was predominantly pore-free. The strength values determined for the castings consisting of the aluminium casting alloys according to the invention E1, E2, E3 are indeed each lower after high temperature loading than in the case of comparison alloy V. For this, the aluminium casting alloys according to the invention E1, E2, E3 can, however, also be cast in large-scale conditions without problem and in an operationally reliable manner. At the same time, the tests prove that the strengths of the cylinder heads cast from aluminium casting alloys according to the invention E1, E2, E3 are double as high as the strengths of standard alloys with comparable castability.

TABLE 1

| | Cu | Si | Zr | Ti | Mn | Fe | Zn | Sr |
|---|---|---|---|---|---|---|---|---|
| E1 | 6.74 | 3.92 | 0.21 | 0.11 | 0.51 | 0.12 | 0.02 | — |
| E2 | 6.67 | 6.28 | 0.22 | 0.11 | 0.51 | 0.12 | 0.02 | — |
| E3 | 6.58 | 6.16 | 0.22 | 0.12 | 0.51 | 0.13 | 0.02 | 0.02 |
| V | 6.72 | 0.06 | 0.22 | 0.11 | 0.5 | 0.08 | 0.02 | — |

Specifications in % by weight
Remainder Al and unavoidable impurities

TABLE 2

| | Rp0,2 [MPa] | Rm [MPa] | A [%] | HB [—] |
|---|---|---|---|---|
| E1 | 179.4 | 284.2 | 2.45 | 92.5 |
| E2 | 170.3 | 266.1 | 1.75 | 94.0 |
| E3 | 173.1 | 276.7 | 2.09 | 96.0 |
| V | 178.6 | 264.5 | 1.92 | 93.0 |

TABLE 3

| | | Duration [h] | | |
|---|---|---|---|---|
| | Alloy | 8 | 100 | 500 |
| Rp0,2 | E1 | 123.27 | 95.72 | 91.71 |
| [MPa] | E2 | 126.89 | 101.49 | 96.46 |
| | V | 193.67 | 186.33 | 193.00 |
| Rm | E1 | 235.69 | 196.33 | 190.57 |
| | E2 | 243.78 | 206.04 | 194.95 |
| | V | 263.33 | 280.67 | 298.67 |
| A | E1 | 3.46 | 3.80 | 4.58 |
| | E2 | 3.51 | 4.59 | 4.76 |
| | V | 1.30 | 1.87 | 2.20 |

TABLE 4

| | Rp0,2 [MPa] | Rm [MPa] | A [%] |
|---|---|---|---|
| E1 | 67.00 | 88.33 | 27.73 |
| E2 | 64.33 | 86.67 | 24.47 |
| E3 | 60.33 | 82.67 | 28.47 |
| V | 106.33 | 148.33 | 21.13 |

TABLE 5

| | Cu | Si | Sr | Ti | Mn | Fe | Zn | Mg |
|---|---|---|---|---|---|---|---|---|
| S1 | 0.52 | 7.11 | 0.02 | 0.10 | 0.12 | 0.14 | 0.02 | 0.39 |
| S2 | 3.97 | 6.18 | 0.02 | 0.11 | 0.31 | 0.47 | 0.34 | 0.37 |

Specifications in % by weight,
Remainder Al and unavoidable impurities

TABLE 6

| | Rp0,2 [MPa] | Rm [MPa] |
|---|---|---|
| S1 | 79 | 91 |
| S2 | 75 | 90 |
| E1 | 95 | 135 |

TABLE 7

| | Rp0,2 [MPa] | Rm [MPa] |
|---|---|---|
| S1 | 35 | 42 |
| S2 | 48 | 55 |
| E1 | 65 | 90 |

The invention claimed is:

1. An aluminium casting alloy, consisting of (in % by weight)

| | |
|---|---|
| Cu: | 6.0-8.0% |
| Mn: | 0.3-0.55% |
| Zr: | 0.18-0.25% |
| Si: | 3.0-7.0% |
| Ti: | 0.05-0.2% |
| Sr: | up to 0.03% |
| V: | up to 0.04% |
| Fe: | up to 0.25% |

remainder aluminium and unavoidable impurities.

2. The aluminium casting alloy according to claim 1, wherein, the Si content is less than 5.0% by weight.

3. The aluminium casting alloy according to claim 2, wherein, the Si content is at least 3.5% by weight.

4. The aluminium casting alloy according to claim 1, wherein, the Si content is at least 5.0% by weight.

5. The aluminium casting alloy according to claim 4, wherein, the Si content is at least 5.5% by weight.

6. The aluminium casting alloy according to claim 1, wherein, the Cu content is at most 7.0% by weight.

7. The aluminium casting alloy according to claim 1, wherein, the Mn content is 0.4-0.55% by weight.

8. The aluminium casting alloy according to claim 1, wherein, the Zr content is 0.2-0.25% by weight.

9. The aluminium casting alloy according to claim 1, wherein, the Ti content is 0.08-0.12% by weight.

10. The aluminium casting alloy according to claim 1, wherein, the Sr content is at least 0.015% by weight.

11. A casting for a combustion engine, cast from an aluminium casting alloy formed according to claim 1.

12. The casting according to claim 11, wherein, the casting is a cylinder head.

* * * * *